US007736091B2

(12) United States Patent
Morizot et al.

(10) Patent No.: US 7,736,091 B2
(45) Date of Patent: Jun. 15, 2010

(54) METHOD AND DEVICE FOR INSERTING A DRAINAGE WICK

(75) Inventors: Jean-Claude Morizot, Paris (FR); Seth Pearlman, Pittsburgh, PA (US); Martin Taube, Pittsburg, PA (US)

(73) Assignee: Freyssinet (FR)

( * ) Notice: Subject to any disclaimer, the term of this patent is extended or adjusted under 35 U.S.C. 154(b) by 655 days.

(21) Appl. No.: 11/528,778

(22) Filed: Sep. 28, 2006

(65) Prior Publication Data

US 2008/0080933 A1 Apr. 3, 2008

(51) Int. Cl.
*E02B 11/00* (2006.01)

(52) U.S. Cl. ..... 405/50; 405/232

(58) Field of Classification Search ..... 405/50, 405/232; 47/81, 48.5; 111/200, 900; 135/120.1, 135/120.2, 120.3, 120.4
See application file for complete search history.

(56) References Cited

U.S. PATENT DOCUMENTS

| | | | | |
|---|---|---|---|---|
| 2,577,252 | A | 12/1951 | Kjellman | |
| 3,396,541 | A | 8/1968 | Lamberton | |
| 3,891,186 | A | 6/1975 | Thorsell | |
| 4,582,611 | A | 4/1986 | Wang | |
| 4,755,080 | A | 7/1988 | Cortlever et al. | |
| 5,584,603 | A | 12/1996 | Cortlever | |
| 5,658,091 | A | 8/1997 | Goughnour | |
| 5,800,090 | A | 9/1998 | Goughnour | |
| 6,179,527 | B1 | 1/2001 | Goughnour | |
| 6,254,308 | B1 | 7/2001 | Cognon | |
| 6,312,190 | B1 | 11/2001 | Goughnour | |
| 6,321,487 | B1 * | 11/2001 | Sardanelli et al. | 47/81 |
| 6,766,817 | B2 | 7/2004 | da Silva | |
| 6,846,130 | B2 | 1/2005 | Goughnour | |
| 6,908,259 | B1 | 6/2005 | Tomlinson | |
| 6,918,404 | B2 | 7/2005 | da Silva | |
| 7,066,586 | B2 | 6/2006 | da Silva | |
| 7,285,255 | B2 | 10/2007 | Kadlec | |
| 2004/0146357 | A1 | 7/2004 | Goughnour | |

(Continued)

FOREIGN PATENT DOCUMENTS

| | | |
|---|---|---|
| EP | 0226251 | 6/1987 |

(Continued)

OTHER PUBLICATIONS

International Search Report, PCT/EP2007/060341 dated Feb. 11, 2008.

(Continued)

*Primary Examiner*—David J Bagnell
*Assistant Examiner*—Sean D Andrish
(74) *Attorney, Agent, or Firm*—Banner & Witcoff, Ltd.

(57) ABSTRACT

A device for and a method of inserting a drainage wick into the ground comprising the steps of:

providing a drainage wick comprising a transversely permeable filter material surrounding a core adapted to longitudinal water circulation, where a portion of said drainage wick is arranged so as to be transversely and/or longitudinally impermeable;

threading said drainage wick through an inserting tube;

fixing an anchorage component to the lower end of said drainage wick extending out of said inserting tube;

driving said anchorage component, said drainage wick and said inserting tube downwardly into the ground; and pulling up said inserting tube whereby said anchorage component and said drainage wick are permitted to remain into said ground.

14 Claims, 4 Drawing Sheets

U.S. PATENT DOCUMENTS

| | | | |
|---|---|---|---|
| 2005/0141964 | A1 | 6/2005 | Tomlinson |
| 2007/0212281 | A1 | 9/2007 | Kadlec |
| 2008/0080933 | A1 | 4/2008 | Morizot |

FOREIGN PATENT DOCUMENTS

| | | |
|---|---|---|
| EP | 0233312 | 8/1987 |
| EP | 0672795 | 9/1995 |
| EP | 1323868 | 2/2003 |
| EP | 1369533 | 12/2003 |
| EP | 1369534 | 12/2003 |
| GB | 1600737 | 10/1981 |
| GB | 2131852 | 6/1984 |
| GB | 2134946 | 8/1984 |
| GB | 92/18702 | 10/1992 |
| JP | 5934320 | 2/1984 |
| WO | 2004/106639 | 12/2004 |

OTHER PUBLICATIONS

E-mail from Elson Silva, PhD, Three very important issues about fluidic devices in the Patenting System regarding Hydrology Fundamentals (3 pages), Apr. 3, 2008.

Unsolicited Email from Elson Silva, PhD, Three very important issues about fluidic devices in the Patenting System regarding Hydrology Fundamentals, (3 pages) Apr. 3, 2008.

Partial International Search Report cited in PCT/EP2007/060344.

* cited by examiner

METHOD AND DEVICE FOR INSERTING A DRAINAGE WICK

BACKGROUND OF THE INVENTION

The invention relates to a method of inserting a drainage wick into the ground and to a device for anchoring the drainage wick.

Drainage wicks are commonly used for carrying out vertical draining in the ground in order to improve the strength of ground and generally consist of paper material in the form of strips or of a band-shaped plastic core enclosed in a suitable filter material. Such drainage wicks are widely used to consolidate soft compressible soils (such as clays and/or fine grained soils). Consolidation of a compressible soil occurs as pore water is squeezed from the soil matrix. The installation of vertical drains provides shortened drainage paths for the water to exit the soil and thus can reduce significantly the settlement time. In order to insert such a drainage wick in the ground, for example to a depth of 10 m, up to 40 or 60 m, the drainage wick is threaded through an inserting tube driven into the ground. When such an inserting tube is extracted from the ground, the drainage wick remains in the soil, the soil pressurizes against the drainage wick, and water may travel through the permeable filter material of the drainage wick along the plastic core.

Such a drainage wick inserting method is disclosed in U.S. Pat. No. 2,577,252 and devices for inserting a drainage wick are known from U.S. Pat. No. 3,891,186 or U.S. Pat. No. 4,755,080. According to prior art methods, the drainage wick is threaded through the inserting tube and an anchorage component, such as a plate or bar, is attached to the lower end of said drainage wick. The drainage wick and anchorage component are then driven downwardly into the ground by means of said inserting tube. The inserting tube is then pulled up whereby the anchorage component and drainage wick are permitted to remain in the ground.

To avoid the anchorage component not remaining at its bottom position when the inserting tube is pulled, the drainage wick and the anchorage component are frequently driven downwardly deeper, to a hard soil layer. The anchorage component is then easily retained in the hard soil layer and the drainage wick is maintained in its bottom position. Such a solution is commonly used, but presents drawbacks. For example, such a process may be unusable due to a geological constraint, such as aquifer presence in the hard soil. It is then necessary to avoid communication between the different soil layers to prevent water contamination.

The same process should also be avoided when using vacuum soil consolidation as disclosed for example in U.S. Pat. No. 6,254,308. Since suction means are used to evacuate the liquid collected from the ground, the draining process would be endless if drainage wicks were to be maintained in contact with underlying permeable soils. Similar problems may be encountered when a hard soil layer, namely an aquifer including layer, is included between two soft soils layers, which need to be drained.

SUMMARY OF THE INVENTION

Thus, it is an object of the invention to resolve such problems of inserting a drainage wick by avoiding the described drawbacks with an inexpensive and contamination free process solution.

The previously mentioned problems may be solved by using a method of inserting a drainage wick into the ground comprising the steps of:

providing a drainage wick where a portion of said drainage wick is arranged so as to be transversely and/or longitudinally impermeable;

threading the drainage wick through an inserting tube;

fixing an anchorage component to the drainage wick extending out of said inserting tube;

driving the anchorage component, drainage wick and inserting tube downwardly into the ground; and pulling up the inserting tube whereby the anchorage component and the drainage wick are permitted to remain in the ground.

Within the scope of the present disclosure, "vertical" has to be understood as being substantially or generally perpendicular to a horizontal line. The ground level is usually substantially horizontal.

"Longitudinal" has to be understood as being substantially or generally parallel to a vertical axis of an inserted drainage wick.

"Transverse" has to be understood as being substantially or generally perpendicular to a vertical axis of an inserted drainage wick.

Widely used anchorage components include plates or bars.

A layer of "soft soil" is a layer where anchoring is difficult such as, for example, mud, muddy soils, limon, vase, pit, pitty soils, soft clays.

A layer of "hard soil" is a layer where anchoring is easier than in a soft soil layer; hard soil layers are, for example, made of sand, sand and gravel, impervious clay, marl, weathered rocks.

Hard soils are usually more permeable than soft soils.

Embodiments of the present invention make possible the general avoidance water communication between soil layers, namely between soft and hard soil layers, especially when a hard soil layer contains an aquifer.

Typically in the practice of the embodiments disclosed, the depth and length of a zone of the ground where water contamination is to be avoided is determined prior to implementing the process. Determination of depth and length of the zone of the ground where water contamination is to be avoided can be done through ground sounding, namely using boreholes, prior to inserting drainage wicks. It is thus possible to determine the different soil layers that form the ground. When water contamination is to be avoided between two soil layers, the length of said zone is typically determined to encompass a point of a first layer close to the upper part of said first layer and a point of a second layer stacked over said first layer, said last point being close to the lower part of said second layer.

In an embodiment of the present invention, the drainage wick comprises a transversely permeable filter material surrounding a core adapted to longitudinal water circulation, where a portion of the drainage wick is arranged so as to be transversely and/or longitudinally impermeable;

According to an embodiment of the invention, a method of inserting a drainage wick into the ground comprises the steps of:

providing a drainage wick where a portion of said drainage wick is impermeably coated or impregnated;

threading said drainage wick through an inserting tube;

fixing an anchorage component to said drainage wick extending out of said inserting tube;

driving said anchorage component, said drainage wick and said inserting tube downwardly into the ground; and pulling up said inserting tube whereby said anchorage component and said drainage wick are permitted to remain into said ground.

In an embodiment of the present invention, the drainage wick comprises a transversely permeable filter material surrounding a core adapted to longitudinal water circulation, where a portion of said permeable filter material is impermeably coated or impregnated.

According to a feature, an embodiment of the method of the present invention comprises the steps of coating or impregnating a portion of transversely permeable filter material on a beforehand cut length of drainage wick and next threading said drainage wick through the lower end of inserting tube.

According to another feature, an embodiment of the method of the present invention comprises the step of coating or impregnating a portion of transversely permeable filter material after unwinding said drainage wick from supply means and before threading said drainage wick through the upper end of inserting tube.

According to a feature of an embodiment of the present invention, the step of coating or impregnating includes a step of dipping in a water proofing material containing solution and/or coating of a waterproofing material containing solution and/or solid. Waterproofing material may be selected, for example, from the group consisting of polymer glue and water activated polymer.

According to a feature of an embodiment of the present invention, an anchorage component and drainage wick are driven downwardly into a first soft soil layer, then into a hard soil layer and next into a second soft soil layer, said layers being stacked.

A zone of the ground where water contamination is to be avoided is frequently situated from close underneath the lower part of said hard soil layer to close above the upper part of said hard soil layer. Thus, according to a further embodiment of the invention, a method of inserting a drainage wick into the ground comprises the steps of:

- providing a drainage wick comprising a transversely permeable filter material surrounding a core adapted to longitudinal water circulation, where a portion of said core is removed from the lower end of said drainage wick;
- threading said drainage wick through an inserting tube;
- fixing an anchorage component to said drainage wick extending out of said inserting tube;
- driving said anchorage component, said drainage wick and said inserting tube downwardly into the ground;
- pulling up said inserting tube whereby said anchorage component and said drainage wick are permitted to remain into said ground.

A feature of the method comprises the steps of:

- closing the lower end of said inserting tube with a shutter before driving said anchorage component and said drainage wick downwardly into the soil
- releasing said shutter before and/or when pulling up said inserting tube.

Adding a shutter to the driving tube may be useful if elements of the soil, namely mud, may penetrate into inserting tube when driving it downwardly into the ground. An anchorage component may constitute such shutter.

Another feature of the method comprises the step of filling the soil zone around the anchorage component with a sealing material such as mud, clay or water expandable material, such as bentonite, water activated polymer, before and/or when said inserting tube is pulled up. It is then possible to further rearrange the soil during the step of pulling up the inserting tube and sealing the soil around the anchorage component. Furthermore when water expendable material is used, water of the soil gets into contact with the water expandable material which volume expands and enhances the sealing of anchorage component into the soil.

As a feature of the method, the anchorage component and the drainage wick are driven downwardly into a layer of hard soil situated underneath a layer of soft soil and the anchorage component and drainage wick are permitted to remain in said layer of hard soil. A zone of the ground where water contamination is to be avoided is frequently situated from underneath the upper part of said hard soil layer to close above the lower part of said soft soil layer.

It is thus possible to avoid water contamination when such a hard soil layer contains aquifer.

In connection with the described method, an embodiment of the device for inserting a drainage wick downwardly into the earth includes:

- an inserting tube that is adapted to surround and protect said drainage wick as the inserting tube penetrates downwardly into the earth,
- a guide such as a mast, which is designed to initially position the inserting tube vertically above the earth,
- means to move the inserting tube from its initial vertical position downwardly with respect to said guide so that the inserting tube and the drainage wick it protects will penetrate into earth; and
- means for coating or impregnating the drainage wick.

According to a feature of said device, means for coating or impregnation may be dipping means. Dipping means may comprise a container filled with a water proofing material containing solution, elevation means suitable to move up and down said container, rolls suitable to drive a drainage wick inside said container when the container is positioned in coating or impregnation position. According to another feature of the device, means for coating or impregnation are pulverization means.

The invention is further described in the detailed description of non limiting embodiments as depicted and explained below.

DESCRIPTION OF PREFERRED EMBODIMENTS

Figure 1:
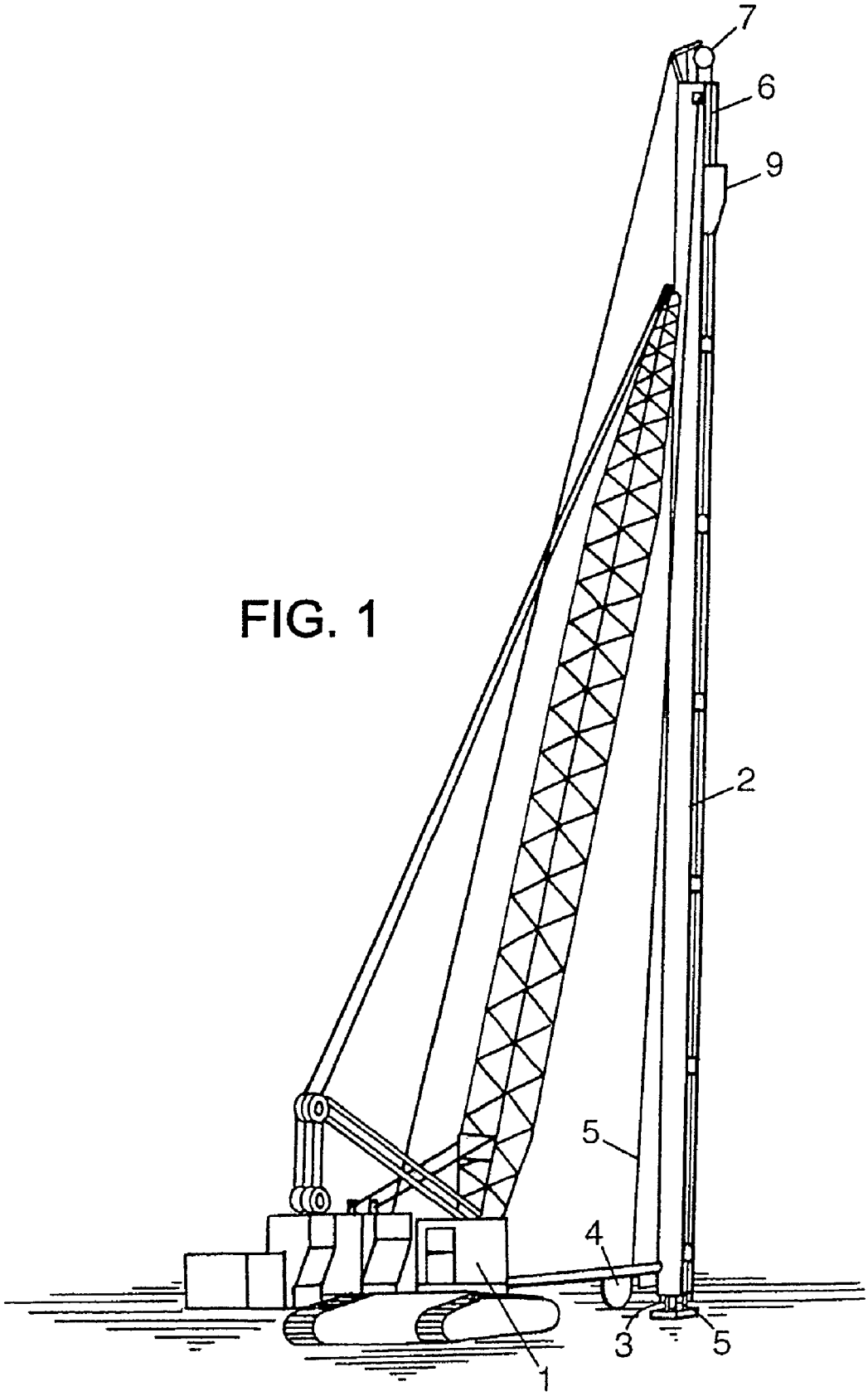
FIG. 1 is a diagrammatic perspective view of a device used for implementing an embodiment of a process according to the invention.

An embodiment of a device used to implement one process according to the invention is shown in FIG. 1 and comprises: a frame formed by a hydraulic crane 1; a guide 2; an inserting tube 3; supply means 4 for the drainage wick; a drive member such as cable 6. Guide 2 is arranged in a generally vertical position in operating conditions.

Drainage wick 5 is inserted into the ground by moving the inserting tube 3 in downward direction through the guide 2 using the cable 6 formed in a closed loop fastened at opposite ends to fastening element 9 attached to inserting tube 3. Drainage wick 5 is received in inserting tube 3. Ends of cable 6 are connected to the fastening element 9 and cable 6 fits over reversing wheel 7 arranged on guide 2. The inserting tube 3 is therefore set into movement by rotating wheel 7 to drive the cable 6. Inserting tube may 3 also be moved into the ground by vibration means.

Figure 2:
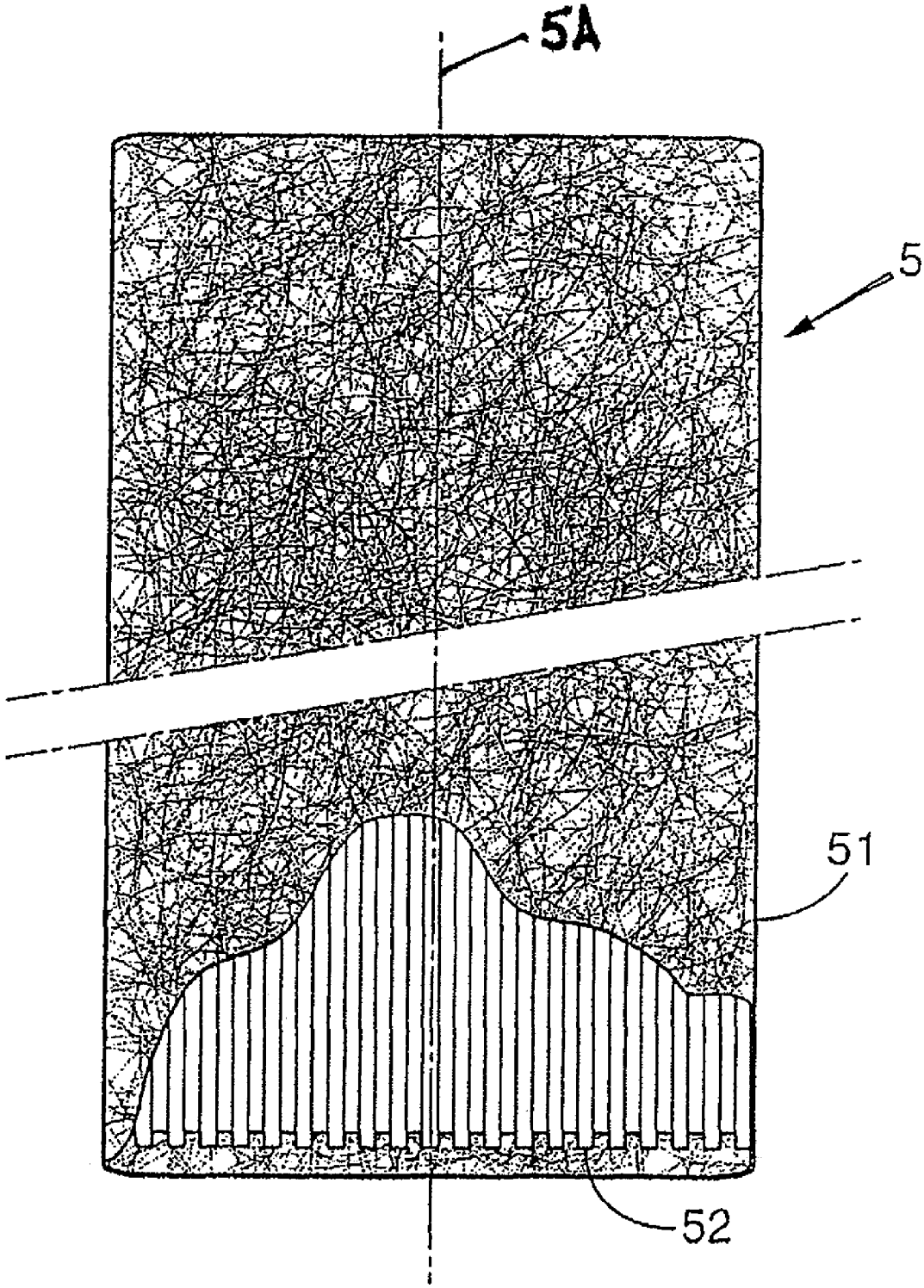
FIG. 2 is a diagrammatic view of a drainage wick used to implement the process.

FIG. 2 depicts a drainage wick 5 used to implement a process according to an embodiment of the invention: such a drainage wick 5 comprises a flexible core 52 adapted to longitudinal water circulation. It is usually manufactured of polypropylene. Both sides include grooves, through which water can flow unimpeded. Core 52 is surrounded by a transversely permeable filter material 51. Filter material 51 is made of strong and durable geotextile filter fabric with excellent filtration properties. Free access of ground water is thus permitted into the drainage wick 5. At the same time, this filter prevents agglomeration of fines from adjacent soils and thus avoids clogging.

A typical drainage wick 5 is manufactured in a strip shape, namely in a width of 100 mm and a thickness of about 5 mm with longitudinal axis 5A. A cylindrical drainage wick comprising cylindrical core is also suitable.

Figure 3:
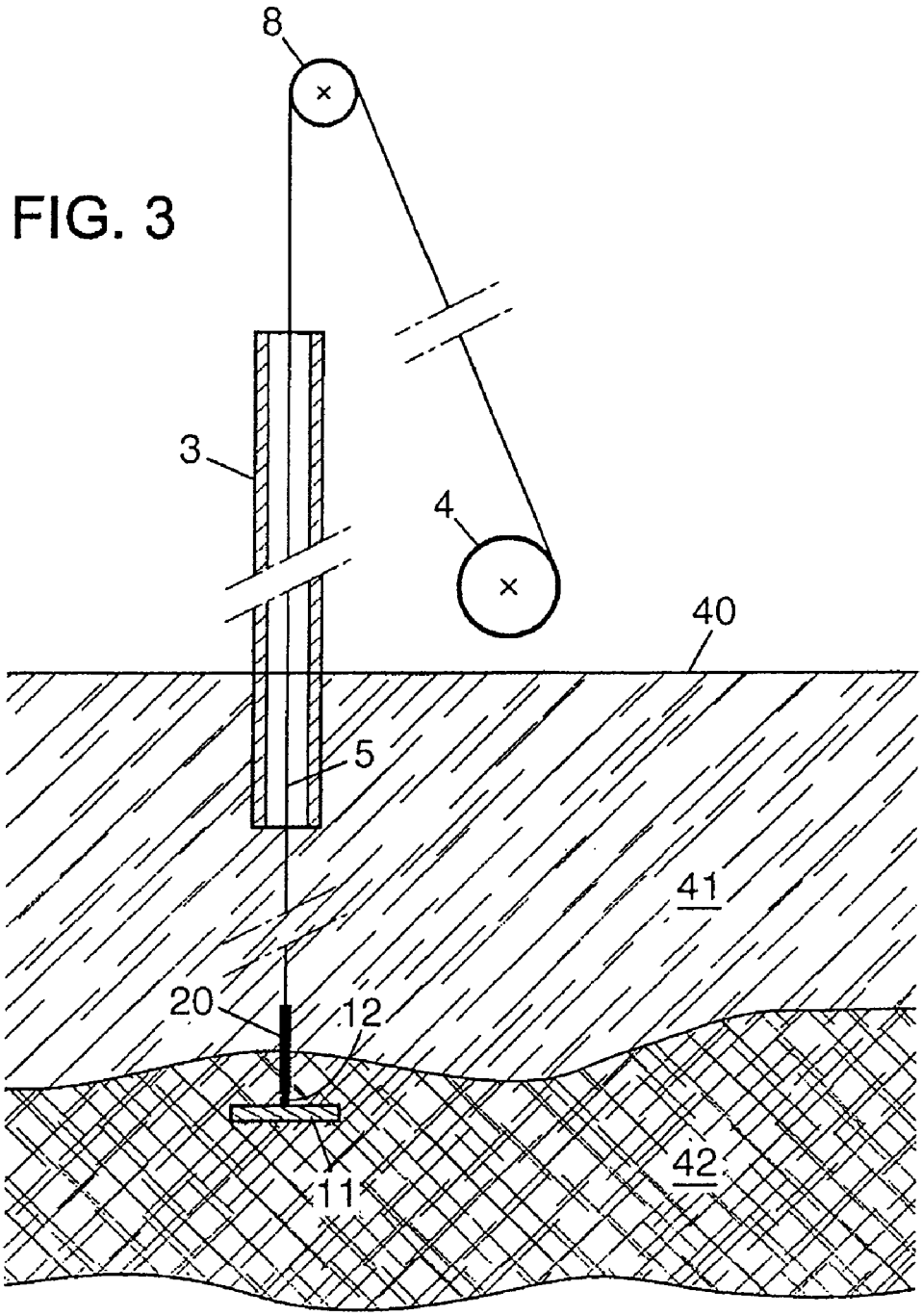
FIG. 3 is a diagrammatic longitudinal section of a portion of apparatus positioned in the ground.

FIG. 3 illustrates an advantageous application of the process. The ground of FIG. 3 consists of two soil layers: layer 41 is a soft soil layer and layer 42 is a hard soil layer, with aquifer presence. Inserting tube 3, anchorage component 11 and the bottom of drainage wick 5 are driven downwardly into the hard soil layer 42, penetrating in the hard soil layer 42. Inserting tube 3 is then pulled up and bottom end of drainage wick 5, fixation point 12 and anchorage component 11 remain in hard soil layer 42. It is thus possible to take advantage of the hard soil layer 42 to fix anchorage component 11 and the soil around anchorage component 11 rearranges or consolidates when pulling up inserting tube 3.

The depth of the upper part of hard soil layer 42 is determined prior to inserting drainage wick 5 into the ground. A portion 20 of drainage wick 5 (eg. Core 52 and filter material 51) is determined where water contamination is to be avoided in a corresponding ground zone. In the present example, water contamination of aquifer presence in hard soil layer 42 is to be avoided. Portion 20 is thus determined as starting from the bottom end of drainage wick 5, near fixation point 12 and coming to a point determined to fit a point of soft soil layer 41, close to the upper part of hard soil layer 42, but sufficiently distant of said upper part to avoid water communication between soil layer 41 and soil layer 42. Portion 20 of bottom part of drainage wick 5 is arranged prior to inserting drainage wick 5 into the ground so as to be transversely and/or longitudinally impermeable. It is thus possible to avoid water contamination when hard soil 42 contains an aquifer table and/or to allow processing vacuum soil consolidation.

According to another embodiment or feature of the process disclosed, a hard soil layer is included between two soft soil layers situated one above the other. When such a hard soil layer includes an aquifer and when both soft soil layers have to be drained, one can determine the depth and length of such hard soil layer and, prior to inserting drainage wick into the three stacked soil layers, arrange a portion of the drainage wick so as to be transversely impermeable.

Figure 4B:
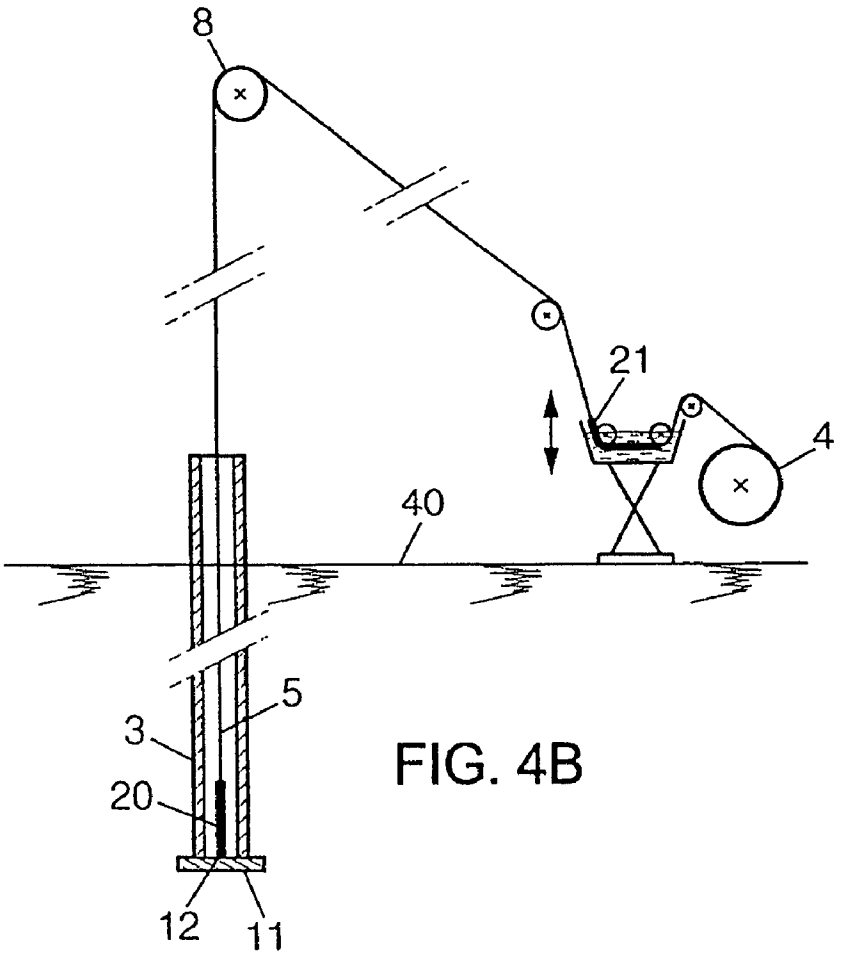
FIGS. 4A and 4B are diagrammatic longitudinal sections of a portion of the equipment according to different process steps of an embodiment of the present invention.
Figure 4A:
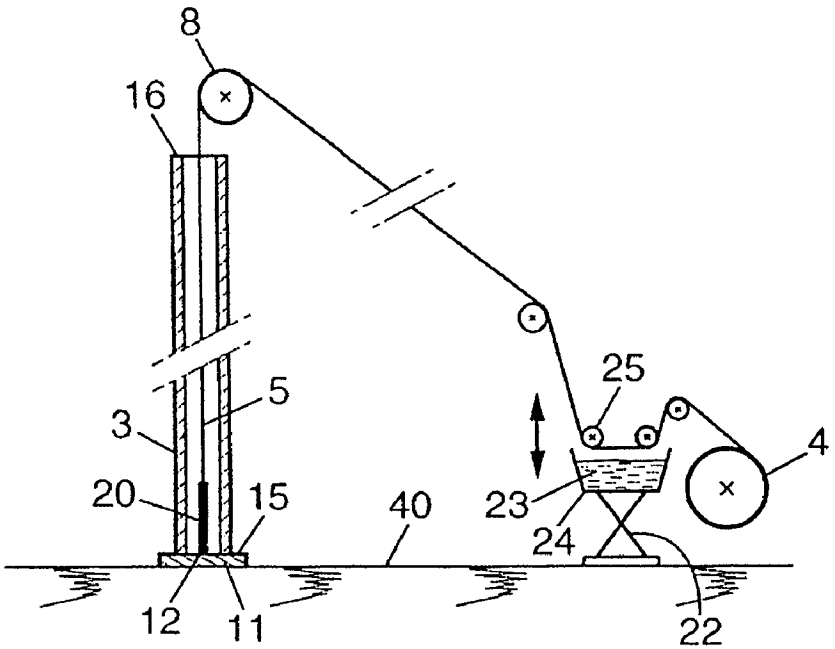

Different steps of an embodiment of the process according to the invention are shown in FIGS. 4A and 4B. FIG. 4 A shows the step before inserting the tube 3 into the ground: a drainage wick is unwound from supply means 4, positioned over a wheel 8 and threaded through inserting tube 3. When the lower end of drainage wick 5 is coming out or close to the lower end 15 of inserting tube 3, one can fix an anchorage component 11 to a fixation point 12 of drainage wick 5. The anchorage component 11 shown in FIG. 4 A is a disc with a diameter is slightly larger than the maximum size of the external part of the section of inserting tube 3 enabling the component to act as a shutter.

The anchorage component 11 is laying on the ground level 40 and the lower end 15 of inserting tube 3 contacts said anchorage component 11. Anchorage component 11 and drainage wick 5 are then driven downwardly into the ground with inserting tube 3. According to an embodiment of the present invention, drainage wick 5 and anchorage component 11 are driven downwardly into the ground by means of inserting tube 3 (see FIG. 4B).

According to another embodiment of the present invention, means are included in the device for inserting the drainage wick so that the distance between wheel 8 and upper part 16 of inserting tube 3 remains constant when driving downwardly inserting tube 3.

When anchorage component 11 and drainage wick 5 have reached their final position, inserting tube 3 is pulled out. After pulling out inserting tube 3, drainage wick 5 is cut near ground level 40 and another drainage wick can be installed.

Referring again to FIG. 4A, a diagrammatic longitudinal section of a portion of the device according to the invention is depicted. The device includes:

- an inserting tube 3 that is adapted to surround and protect the drainage wick 5 as the inserting tube 3 penetrates downwardly into the earth,
- a guide such as a mast 2 or pole or shaft, which is designed to initially position the inserting tube 3 generally vertically above the earth,
- means to move the inserting tube 3 from its initial vertical position downwardly with respect to the guide 2 so that the inserting tube 3 and the drainage wick 5 it protects will penetrate into earth; and
- means for coating or impregnating the drainage wick 5.

The coating or impregnating means may include a container 24 filled with a water proofing material containing solution 23, elevation means suitable to move up and down container 24, such as an up and down motorized platform 22 supporting said container 24, rolls 25 suitable to drive drainage wick 5 inside container 24 when container 24 is positioned so as to operate coating or impregnation. Coating or impregnation means are not operating as shown on FIG. 4A and are operating as shown on FIG. 4B. Container 24 of FIG. 4A is at its rest position, motorized platform 22 is in a low position and drainage wick 5 remains uncoated or unimpregnated. Alternatively, container 24 of FIG. 4 B has been raised through motorized platform 22 and drainage wick 5 dips in solution 23 to coat the wick 5.

The invention is not restricted to the above described embodiments which can be varied in a number of ways within the scope of the claims.

The invention claimed is:

1. A method of inserting a drainage wick into a ground comprising a layer of hard soil situated underneath a layer of soft soil comprising the steps of:

- providing the drainage wick where a portion of said drainage wick is arranged so as to be transversely and/or longitudinally impermeable;
- determining a depth of an upper part of the hard soil layer;
- determining the portion of the drainage wick starting from the bottom end of the drainage wick to a point determined to fit a point of the soft soil layer, close to the upper part of the hard soil layer, but sufficiently distant of the upper part of the hard soil layer to avoid water communication between the said soft soil layer and the said hard soil layer;

arranging said portion of the drainage wick so as to be transversely and/or longitudinally impermeable;

threading said drainage wick through an inserting tube;

fixing an anchorage component to said drainage wick extending out of said inserting tube;

driving said anchorage component, said drainage wick and said inserting tube downwardly into the ground;

where said anchorage component and said drainage wick are driven downwardly into the layer of hard soil situated underneath the layer of soft soil and said anchorage component and said drainage wick are permitted to remain in said layer of hard soil; and pulling up said inserting tube whereby said anchorage component and said drainage wick are permitted to remain in said ground.

2. A method according to claim 1 where the drainage wick comprises a transversely permeable filter material surrounding a core adapted to longitudinal water circulation.

3. A method according to claim 1 comprising the steps of:

closing the lower end of said inserting tube with a shutter before driving said anchorage component and said drainage wick downwardly into the ground releasing said shutter before and/or when pulling up said inserting tube.

4. A method according to claim 1 comprising the step of filling a soil zone around the anchorage component with a sealing material before and/or when said inserting tube is pulled up.

5. A method of inserting a drainage wick into a ground comprising a layer of hard soil situated underneath a layer of soft soil comprising the steps of:

providing the drainage wick where a portion of said drainage wick is impermeably coated or impregnated;

determining a depth of an upper part of the hard soil layer;

determining the portion of the drainage wick starting from the bottom end of the drainage wick to a point determined to fit a point of the soft soil layer, close to the upper part of the hard soil layer, but sufficiently distant of the upper part of the hard soil layer to avoid water communication between the said soft soil layer and the said hard soil layer;

arranging said portion of the drainage wick so as to be transversely and/or longitudinally impermeable;

threading said drainage wick through an inserting tube;

fixing an anchorage component to said drainage wick extending out of said inserting tube;

driving said anchorage component, said drainage wick and said inserting tube downwardly into the ground;

where said anchorage component and said drainage wick are driven downwardly into the layer of hard soil situated underneath the layer of soft soil and said anchorage component and said drainage wick are permitted to remain in said layer of hard soil; and pulling up said inserting tube whereby said anchorage component and said drainage wick are permitted to remain in said ground.

6. A method according to claim 5 where the drainage wick comprises a transversely permeable filter material surrounding a core adapted to longitudinal water circulation and where a portion of said permeable filter material is impermeably coated or impregnated.

7. A method according to claim 6 comprising the steps of coating or impregnating said portion of said transversely permeable filter material on a beforehand cut length of the drainage wick and next threading said drainage wick through the lower end of the inserting tube.

8. A method according to claim 6 comprising the step of coating or impregnating said portion of said transversely permeable filter material after unwinding said drainage wick from supply means and before threading said drainage wick through the upper end of the inserting tube.

9. A method according to claim 5 where the step of coating or impregnating includes a step of dipping said wick in a water proofing material containing solution.

10. A method according to claim 5 comprising the steps of:

closing the lower end of said inserting tube with a shutter before driving said anchorage component and said drainage wick downwardly into the ground releasing said shutter before and/or when pulling up said inserting tube.

11. A method according to claim 5 comprising the step of filling a soil zone around the anchorage component with a sealing material before and/or when said inserting tube is pulled up.

12. A method of inserting a drainage wick into a ground comprising a layer of hard soil situated underneath a layer of soft soil comprising the steps of:

providing the drainage wick comprising a transversely permeable filter material surrounding a core adapted to longitudinal water circulation, where a portion of said core is removed from the lower end of said drainage wick;

determining a depth of an upper part of the hard soil layer;

determining the portion of the drainage wick starting from the bottom end of the drainage wick to a point determined to fit a point of the soft soil layer, close to the upper part of the hard soil layer, but sufficiently distant of the upper part of the hard soil layer to avoid water communication between the said soft soil layer and the said hard soil layer;

arranging said portion of the drainage wick so as to be transversely and/or longitudinally impermeable;

threading said drainage wick through an inserting tube;

fixing an anchorage component to said drainage wick extending out of said inserting tube;

driving said anchorage component, said drainage wick and said inserting tube downwardly into the ground;

where said anchorage component and said drainage wick are driven downwardly into the layer of hard soil situated underneath the layer of soft soil and said anchorage component and said drainage wick are permitted to remain in said layer of hard soil; and pulling up said inserting tube whereby said anchorage component and said drainage wick are permitted to remain in said ground.

13. A method according to claim 12 comprising the steps of:

closing the lower end of said inserting tube with a shutter before driving said anchorage component and said drainage wick downwardly into the ground releasing said shutter before and/or when pulling up said inserting tube.

14. A method according to claim 12 comprising the step of filling a soil zone around the anchorage component with a sealing material before and/or when said inserting tube is pulled up.

* * * * *